US011732886B2

(12) United States Patent
Taylor et al.

(10) Patent No.: US 11,732,886 B2
(45) Date of Patent: Aug. 22, 2023

(54) FUEL-FIRED BURNER WITH INTERNAL EXHAUST GAS RECYCLE

(71) Applicant: Honeywell International Inc., Morris Plains, NJ (US)

(72) Inventors: Curtis Lynn Taylor, Paradise Valley, AZ (US); Umesh Chandra Bhayaraju, Anderson, IN (US); Bradley Dean Patterson, Dunkirk, IN (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 259 days.

(21) Appl. No.: 17/103,123

(22) Filed: Nov. 24, 2020

(65) Prior Publication Data

US 2022/0163197 A1 May 26, 2022

(51) Int. Cl.

| | |
|---|---|
| ***F23C 9/00*** | (2006.01) |
| ***F23D 11/40*** | (2006.01) |
| ***F23D 17/00*** | (2006.01) |

(52) U.S. Cl.

CPC ..... *F23C 9/006* (2013.01); *F23D 11/402* (2013.01); *F23D 17/002* (2013.01); *F23C 2202/30* (2013.01)

(58) Field of Classification Search

CPC ..... F23C 9/006; F23D 11/402; F23D 14/002

USPC ..... 431/115–116

See application file for complete search history.

(56) References Cited

U.S. PATENT DOCUMENTS

| | | | | |
|---|---|---|---|---|
| RE24,682 E | | 4/1959 | Johnson | |
| RE24,862 E | * | 8/1960 | Johnson | B25H 3/003 206/378 |
| 3,174,526 A | * | 3/1965 | Von Linde | F23C 9/006 431/116 |

(Continued)

FOREIGN PATENT DOCUMENTS

| | | | |
|---|---|---|---|
| EP | 0 657 689 | A1 | 6/1995 |
| JP | 54-54339 | A | 4/1979 |
| WO | 2015/072629 | A1 | 5/2015 |

OTHER PUBLICATIONS

Canadian Office Action dated Jan. 12, 2023; issued in connection with corresponding Canadian Patent Application No. 3,138,927 (5 pages total).

(Continued)

*Primary Examiner* — Vivek K Shirsat

(74) *Attorney, Agent, or Firm* — John Maldjian; Stevens & Lee PC

(57) ABSTRACT

A fuel-fired burner 100 includes a combustion air inlet 113 for receiving combustion air coupled to a combustion air nozzle 136 at an input to a second chamber 152 within a burner housing 110 spaced apart from a third chamber 168 within the second chamber. The combustion air nozzle 136 directs the combustion air 171 into the third chamber 168. A fuel inlet 111 coupled to a burner nozzle 167 secured to a burner mounting plate 161 has a recycle port 164 for receiving hot exhaust gas provided to an exhaust gas path 165. A jet pump located entirely inside the burner housing is configured to receive the hot exhaust gas from the exhaust gas path. The jet pump operates by flowing the combustion air through the combustion air nozzle 136 which suctions in the hot exhaust gas through the recycle port into the exhaust gas path then into a gas mixing zone 178 for mixing the hot exhaust gas and the combustion air.

18 Claims, 4 Drawing Sheets

(56) References Cited

U.S. PATENT DOCUMENTS

| | | | |
|---|---|---|---|
| 10,451,271 | B2 | 10/2019 | Taylor et al. |
| 10,533,741 | B2 | 1/2020 | Taylor et al. |

OTHER PUBLICATIONS

Extended European Search Report dated Apr. 22, 2022; issued in connection with corresponding European Patent Application No. 21207800.0 (5 pages total).

* cited by examiner

FUEL-FIRED BURNER WITH INTERNAL EXHAUST GAS RECYCLE

FIELD

Disclosed aspects relate to fuel-fired burners having exhaust gas recycling.

BACKGROUND

Oxides of nitrogen in the form of nitrogen oxide (i.e., NO) and nitrogen dioxide ($NO_2$) that can collectively be referred to as NOx, are generated by the burning of fossil fuels in the air which provides the nitrogen and the oxygen in the form of diatomic gases for forming NOx. Along with NOx emitted from motor vehicles, NOx from fossil fuel-fired industrial and commercial heating equipment (e.g., furnaces, ovens) is known to emit NOx and thus, besides motor vehicles, is also recognized to be a major contributor to poor air quality and also smog.

Recycling of combustion exhaust gas (also known as flue gas) commonly known as exhaust gas recycling (EGR) is a known method to achieve lower NOx emissions in fossil fuel-fired combustion applications. Numerous studies have evidenced the beneficial effect of recycling combustion exhaust gas using a variety of external piping arrangements. However, the addition of EGR to any fired chamber application generally involves increased equipment complexity, capital, and/or operational expense.

One conventional method to achieve EGR for industrial fuel-fired burners is to have the exhaust gas externally piped back from the exhaust stack to the combustion air intake where it can enter the combustion air fan to be mixed with the combustion air, where this exhaust gas and air mixture is sent to an air inlet of the burner. This known EGR arrangement needs additional piping and apparatus around (external to) the fuel-fired burner. This known EGR arrangement also involves an enlargement (or up-sizing) of the combustion air fan to handle the increased volume of the added flue gas. Larger air fans result in increased cost and also use more electricity per unit of heat produced. Moreover, the fan materials of construction generally need upgrading to higher temperature capable alloys needed to handle the additional temperature and corrosive compositions generally present in the exhaust gas.

SUMMARY

This Summary is provided to introduce a brief selection of disclosed concepts in a simplified form that are further described below in the Detailed Description including the drawings provided. This Summary is not intended to limit the claimed subject matter's scope.

Disclosed aspects recognize in order to more economically implement EGR for fuel-fired burners, what is needed is a fuel-fired burner arrangement that lowers capital and operating costs by reducing the complexity of the EGR for the burner. Disclosed aspects accomplish this by utilizing a jet pump arrangement that is located entirely inside the burner housing which eliminates the previously needed externally positioned hot exhaust gas piping, as well as the special fan and associated controls needed to mix the exhaust gas and the combustion air in proper proportions.

One disclosed aspect comprises a fuel-fired burner that includes a combustion air inlet for receiving combustion air coupled to a combustion air nozzle at an input to a second chamber within a burner housing spaced apart from a third chamber that is within the second chamber. The combustion air nozzle directs the combustion air into the third chamber. A fuel pipe having a fuel inlet is coupled to a burner nozzle secured to a burner mounting plate having a recycle port(s) for receiving hot exhaust gas provided to the second chamber. A jet pump located entirely inside the burner housing is configured to receive the exhaust gas from the second chamber. The jet pump operates by flowing the combustion air through the combustion air nozzle which suctions in the hot exhaust gas through the recycle port into an exhaust gas path bounded by the second chamber then into a gas mixing zone extending from an output of the combustion air nozzle to an input end of the third chamber for mixing the hot exhaust gas and the combustion air.

BRIEF DESCRIPTION OF THE DRAWINGS

FIG. 2A depicts a view looking at the back of an example fuel-fired burner showing the burner mounting plate having recycle ports attached to the wall plate. FIG. 2B depicts a fuel-fired burner taken along the cut line B-B shown in FIG. 2A. FIG. 2C depicts a side cut view of the fuel-fired burner shown in FIG. 2A.

DETAILED DESCRIPTION

Figure 1A:
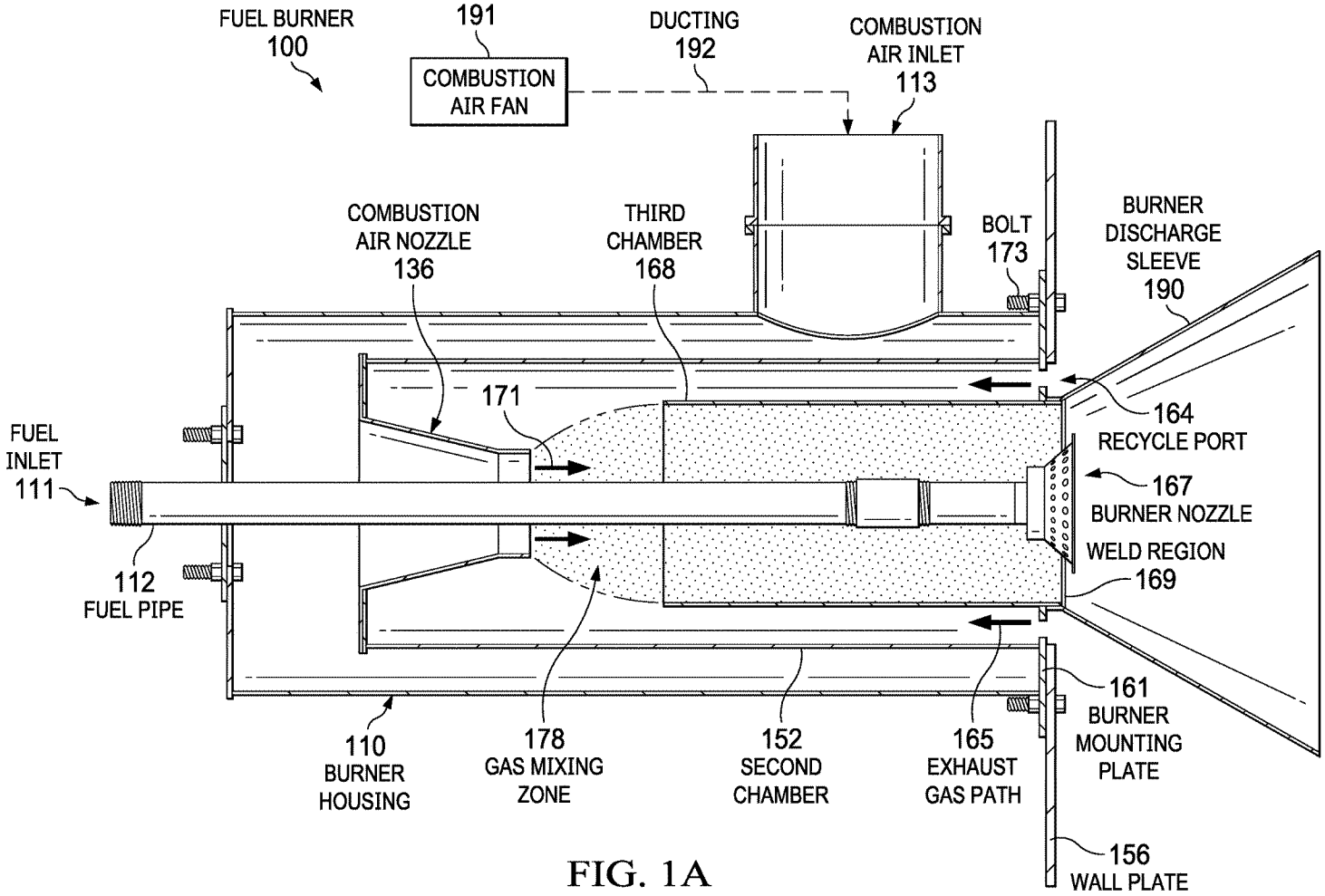
FIG. 1A depicts a cross-sectional view of an example fuel-fired burner including EGR comprising a jet pump arrangement provided entirely inside the burner housing, according to an example aspect.

Disclosed aspects are described with reference to the attached figures, wherein like reference numerals are used throughout the figures to designate similar or equivalent elements. The figures are not drawn to scale and they are provided merely to illustrate certain disclosed aspects. Several disclosed aspects are described below with reference to example applications for illustration. It should be understood that numerous specific details, relationships, and methods are set forth to provide a full understanding of the disclosed aspects.

Disclosed aspects comprise a fuel-fired burner including EGR including a jet pump arrangement located entirely inside the burner housing that mixes exhaust gas with combustion air. As used herein the term "jet pump" refers to a passive pump (meaning the pump is not supplied any electrical power), where the jet pump is configured so that a small jet of a fluid that is in rapid motion lifts or otherwise moves by its impulse a large quantity of the fluid with which it mingles, in this case, exhaust gas. A jet pump thus operates by what is more generally called the Venturi effect.

FIG. 1A depicts a cross-sectional view of an example fuel-fired burner 100 shown as a fuel burner, according to an example aspect, including EGR comprising a jet pump arrangement provided entirely inside the burner housing 110 that mixes hot exhaust gas (also known as flue gas) received through a recycle port 164 formed (such as cut) in a burner mounting plate 161 to a recycled exhaust gas path (exhaust gas path) 165. The exhaust gas path 165 is bounded by an outside of a third chamber 168 and an inside of a second chamber 152 which enables the exhaust gas to flow into a gas mixing zone 178 as shown between the combustion air nozzle 136 and the input to the third chamber 168. The burner mounting plate 161 closes and seals the burner housing 110 (sealed other than the recycle port 164) on the side of the fuel-fired burner 100 having the burner nozzle 167. A fuel pipe 112 having a fuel inlet 111 is coupled to the burner nozzle 167.

The fuel-fired burner 100 also includes another plate shown as a wall plate 156 that can represent a mounting wall in the customer's application for the fuel-fired burner 100. FIG. 1A shows the burner discharge sleeve 190 connected to the third chamber 168 by a weld region 169. The wall plate 156 is shown provided with a hole in its center region to enable insertion and thus the connection of the burner discharge sleeve 190 two the third chamber 168. A wall plate 156 with a hole in the center region is generally provided by the customer. For example, enabled by the hole in the wall plate 156, the burner discharge sleeve 190 can be connected (e.g., welded) to the third chamber 168 as shown in FIG. 1A. Alternatively, the burner discharge sleeve 190 can be connected (e.g., welded) to the portion of the burner mounting plate 161 radially inside the recycle port 164. Both of these options allow for the fuel-fired burner 100 to be inserted into the customer's application chamber, such as a boiler, furnace or a heater, as a single unit.

Figure 2A:
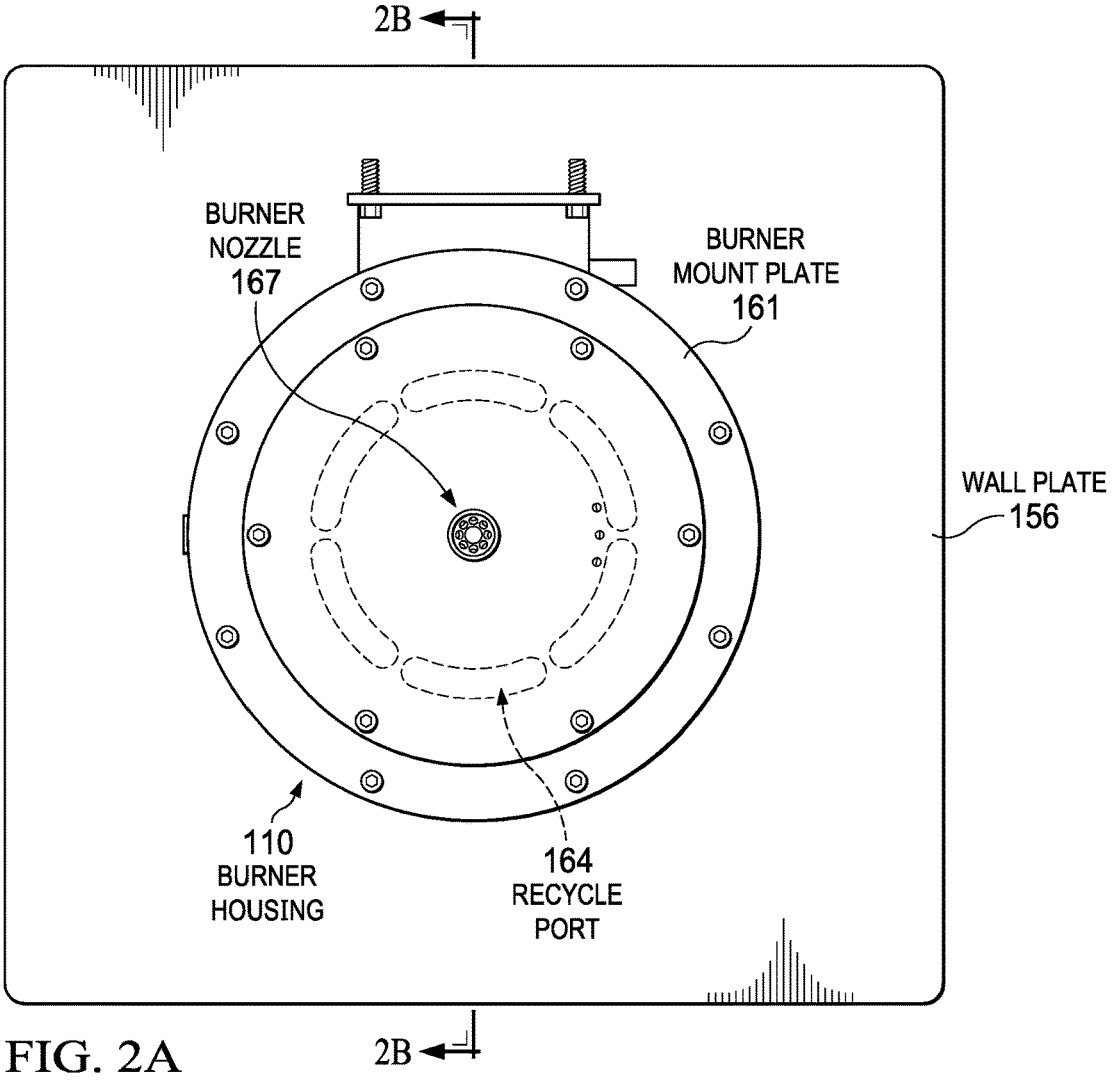
FIGS. 2A-C depict various views of the example fuel-fired burner including EGR comprising a jet pump arrangement provided all inside the burner housing that mixes hot exhaust gas with combustion air to provide internal exhaust gas recycle as shown in FIG. 1A, according to an example aspect.

The wall plate 156 comprises a generic plate that represents the wall of another apparatus that receives heat from combustion performed by the fuel-fired burner 100, such as a boiler, furnace, or heater. The wall plate 156 generally has an opening large enough for the burner discharge sleeve 190 to pass through for mounting and still have enough surface area to place welded mounting studs on the wall plate 156. The burner mounting plate 161 generally includes mounting holes in the flange portion and the recycle port(s) 164 in the central area as shown in FIG. 2A described below. The burner mounting plate 161 is generally welded to the third chamber 168 as shown in FIG. 1A, and the burner housing 110, and the burner mounting plate 161 generally has a dimension generally being a diameter that is larger than the burner housing 110 (and the opening in the application wall) to create a mounting flange with holes for the studs of the wall plate 156 to pass through.

The gas mixing zone 178 is between an output of a combustion air nozzle 136 and the burner mounting plate 161. The gas mixing zone 178 is for mixing hot exhaust gas with combustion air propelled by a combustion air fan 191 through ducting 192 to a combustion air inlet 113 that flows through the combustion air nozzle 136 to provide an internal EGR.

Although shown as an external combustion air fan 191 coupled by ducting 192 to the combustion air inlet 113, the combustion air fan 191 can also be located in other locations. For industrial fuel-fired burners that generally need large volume combustion air flows at a relatively high pressure, the combustion air fan 191 is generally mounted away from the fuel-fired burner 100 and is ducted to the combustion air inlet 113 as shown in FIG. 1A. In some other arrangements, particularly if the air flow and pressure needs of the fuel-fired burner are lower, the combustion air fan 191 can be mounted directly onto the combustion air inlet 113 of the fuel-fired burner 100 so that no ducting 192 is needed.

In another arrangement, the burner discharge sleeve 190 can be made of a refractory material, such as configured as a block. In the case the burner discharge sleeve 190 comprises a block of generally a refractory material, the third chamber 168 would be extended slightly past the plane of the burner mounting plate 161 to slide as an open cylinder into an opening of this block. The internal flared shape for the burner discharge sleeve 190 is generally maintained whether the burner discharge sleeve 190 comprises a block or comprises sheet metal. The burner discharge sleeve 190 can represent any firing chamber that such a fuel-fired burner can fire into, such as a boiler or a heater.

There is no requirement to electronically control the exhaust flow entering through the recycle port(s) 164 into the jet pump because passive control can be used since variations in the flow of combustion air from the combustion air fan 191 will cause the amount of suction in the jet pump to vary to automatically increase or decrease the amount of exhaust gas being suctioned through the recycle port(s) 164 via the exhaust gas path 165 into the jet pump. The size of the recycle port(s) 164 can be designed to determine the amount of exhaust flowing into the exhaust gas path 165 to be utilized by the jet pump. The recycle port(s) 164 can be sized and fixed in their size based on the amount of suction that is produced by the jet pump at a given combustion air flow rate.

The materials of construction for the combustion air fan 191 can vary, but most combustion fans comprise steel. The size of the combustion air fan 191 is selected by the fuel-fired burner designer to meet the pressure and volume requirements for the combustion air. The design of the combustion air fan depends on the rotations per minute (rpm), wheel (or blower impeller) diameter, and the wheel width. A bigger wheel in the combustion fan provides a higher volume of combustion air.

A combustion air fan 191 provides the proper combustion air volume and pressure through the combustion air inlet 113 into the burner housing 110, which is connected to the jet pump nozzle. Although not shown in FIG. 1A, the fuel, and the air can be controlled using individual valves on the air and fuel lines that are driven by a control signal from the system that monitors the stack exhaust oxygen level. Alternatively, such valves can be driven by controllers for measuring the air and fuel flow and holding these flows to a preset ratio. As described above, the air exiting the combustion air nozzle 136 functioning as a jet pump nozzle drives the jet pump to suck in exhaust gas from the recycle port 164 through the exhaust gas path 165 to the gas mixing zone 178.

In operation of a disclosed fuel-fired burner, the jet pump, utilizing a centrally positioned combustion air nozzle 136 creates a negative pressure condition when the combustion air fan 191 is operating. This negative pressure is operable to pull hot exhaust gas from the exhaust gas path 165 into the gas mixing zone 178 without the use of an additional fan or the need to up-size the combustion air fan 191. The exhaust gas enters the burner housing 110 as described above through the recycle port 164 in the burning mounting plate 161 of the burner, where the exhaust gas is suctioned into the exhaust gas path 165 then into the gas mixing zone 178 where it is mixed with the combustion air, and then passes through the third chamber 168 into the burner discharge sleeve 190 where the exhaust gas and air mixture can be mixed with fuel in various ways to provide a flame emerging from the burner nozzle 167.

The resulting mixture of combustion air, exhaust gas, and fuel gas, results in a combustion which produces a flame with a lower level of NOx emissions as compared to a flame without EGR. It is this lower level of NOx emissions provided by disclosed fuel-fired burners that is believed to make disclosed fuel-fired burners and related aspects particularly valuable. Disclosed aspects create this low NOx emissions result without the use of external hot exhaust gas piping, without the need for an upsized and/or upgraded combustion air fan, or additional controls, and without the associated safety concerns of having external hot exhaust piping running through the work area of a plant.

As described above, the disclosed fuel-fired burner comprising a jet pump arrangement are sized and located entirely inside the burner housing 110. The combustion air fan 191 provides the proper combustion air volume and pressure into the burner housing 110, which is connected to the combustion air nozzle 136. The combustion air nozzle 136 ejects high velocity combustion air outward from its outlet including into the third chamber 168. The high velocity combustion air exiting the combustion air nozzle 136 drives the jet pump. The jet pump, which can include more than one combustion air nozzle 136, creates a negative pressure condition when the combustion air fan 191 is operating that suctions in hot exhaust gas through the recycle port 164 through the exhaust gas path 165 to the gas mixing zone 178.

There can optionally be a butterfly type control valve in the combustion air and fuel supply lines with control by a control system in the plant where the fuel-fired burner 100 is installed, where the control system can provide air and fuel ratio control for the fuel-fired burner 100. In that case the fuel-fired burner 100 is connected to the plant's fuel and air control system. described combustion air blowers connected to the burner, and combustion air blowers connected via duct work. This is an alternative to the ducted air arrangement shown in FIG. 1A including ducting 192, where control valve for the air would typically be placed in the ducting 192 either by the manufacturer of the fuel-fired burner 100, or by others.

This negative pressure, suctions exhaust gas from the recycle port 164 to the exhaust gas path 165 into the gas mixing zone 178 without the use of an additional fan or the need to up-size the combustion air fan. The exhaust gas thus enters the burner housing 110 through recycle port(s) 164 in the burner mounting plate 161 which is transported by an interior sleeve referred to herein as the exhaust gas path 165, and is mixed in the gas mixing zone 178 with the combustion air, and then passes into the burner discharge sleeve 190 where it can be mixed with fuel in various ways to provide a flame at the burner outlet around the burner nozzle 167.

Figure 1B:
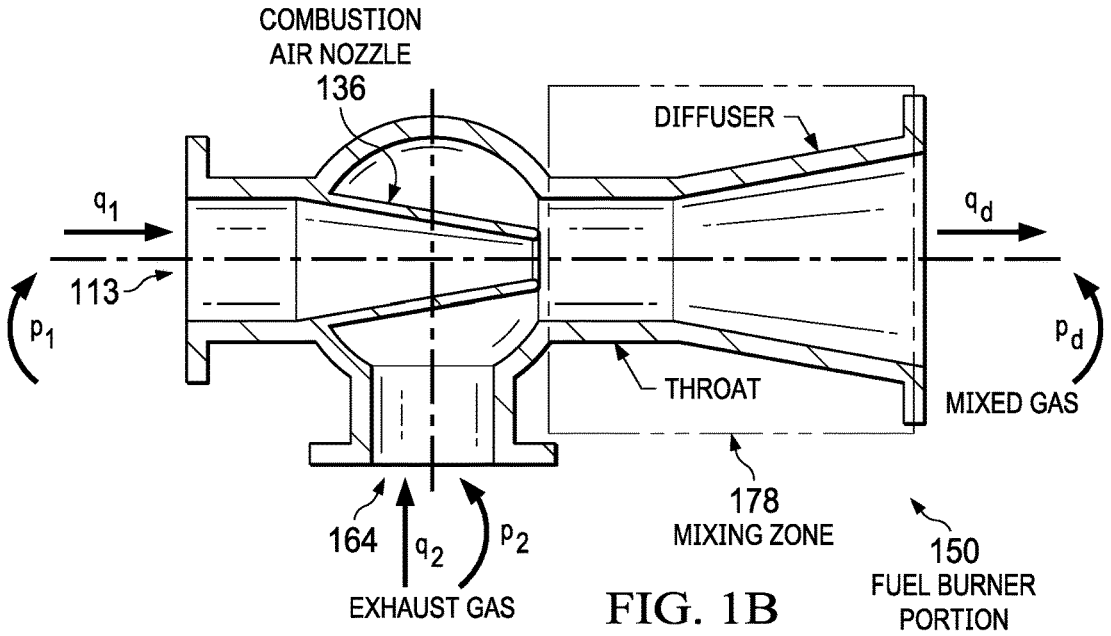
FIG. 1B depicts a generalized jet pump, with the various regions of the jet pump with their respective reference numbers shown in FIG. 1A added to so that the jet pump can be considered to be a portion of a disclosed fuel-fired burner.

FIG. 1B depicts a generalized jet pump, with the various regions of the jet pump with their respective reference numbers shown in FIG. 1A added to so that the jet pump can be considered to be a disclosed internal jet pump now shown as fuel-fired burner portion 150. A high velocity jet of gas shown as $q_1$ at a pressure of $P_1$ corresponds to combustion air propelled by the combustion air fan 191 shown in FIG. 1A after it exits a combustion air nozzle 136 positioned in the burner housing 110 with an arrow depicting this combustion air 171 flowing in the gas mixing zone 178 as shown in FIG. 1A.

The combustion air when flowing left to right in FIG. 1A between an output of the combustion air nozzle 136 and the burner mounting plate 161 creates an impulse sufficient to suction in a second gas (shown in FIG. 1B as $q_2$ at a pressure of $P_2$), in this case being the hot exhaust gas entering through the recycle port 164 to the gas mixing zone 178, to mix with air from the combustion air fan (see the combustion air fan 191 in FIG. 1A), so that the gas mixing zone 178 creates a larger combined volume of the mixed gas as compared to the volume of the combustion air supplied by the combustion air fan 191. The "qd" in FIG. 1B shown at a pressure of $P_d$ at an output of the fuel-fired burner portion 150 is the mixed gas (combustion air mixed with the hot recycled exhaust gas).

Figure 2B:
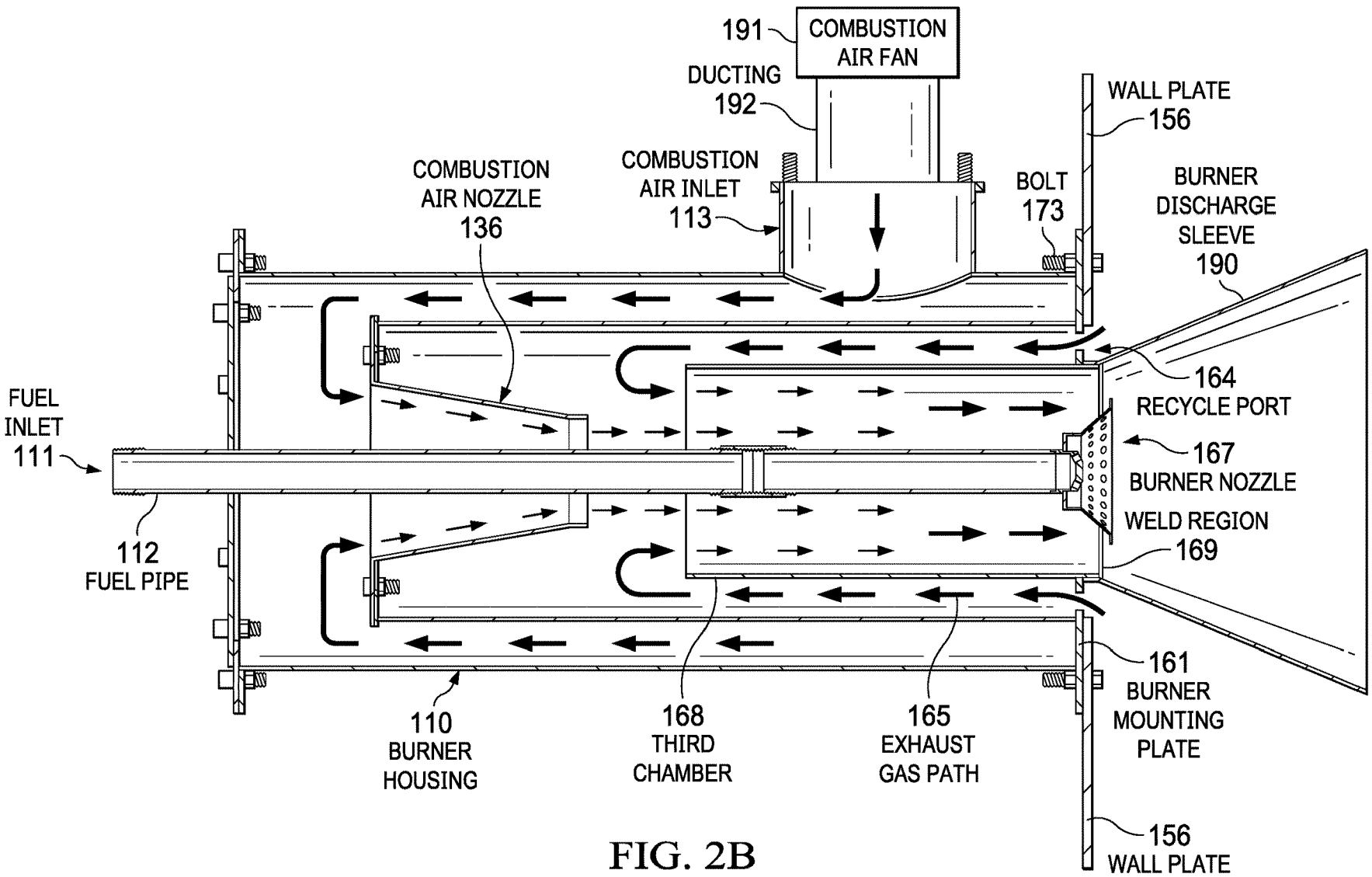
Figure 2C:
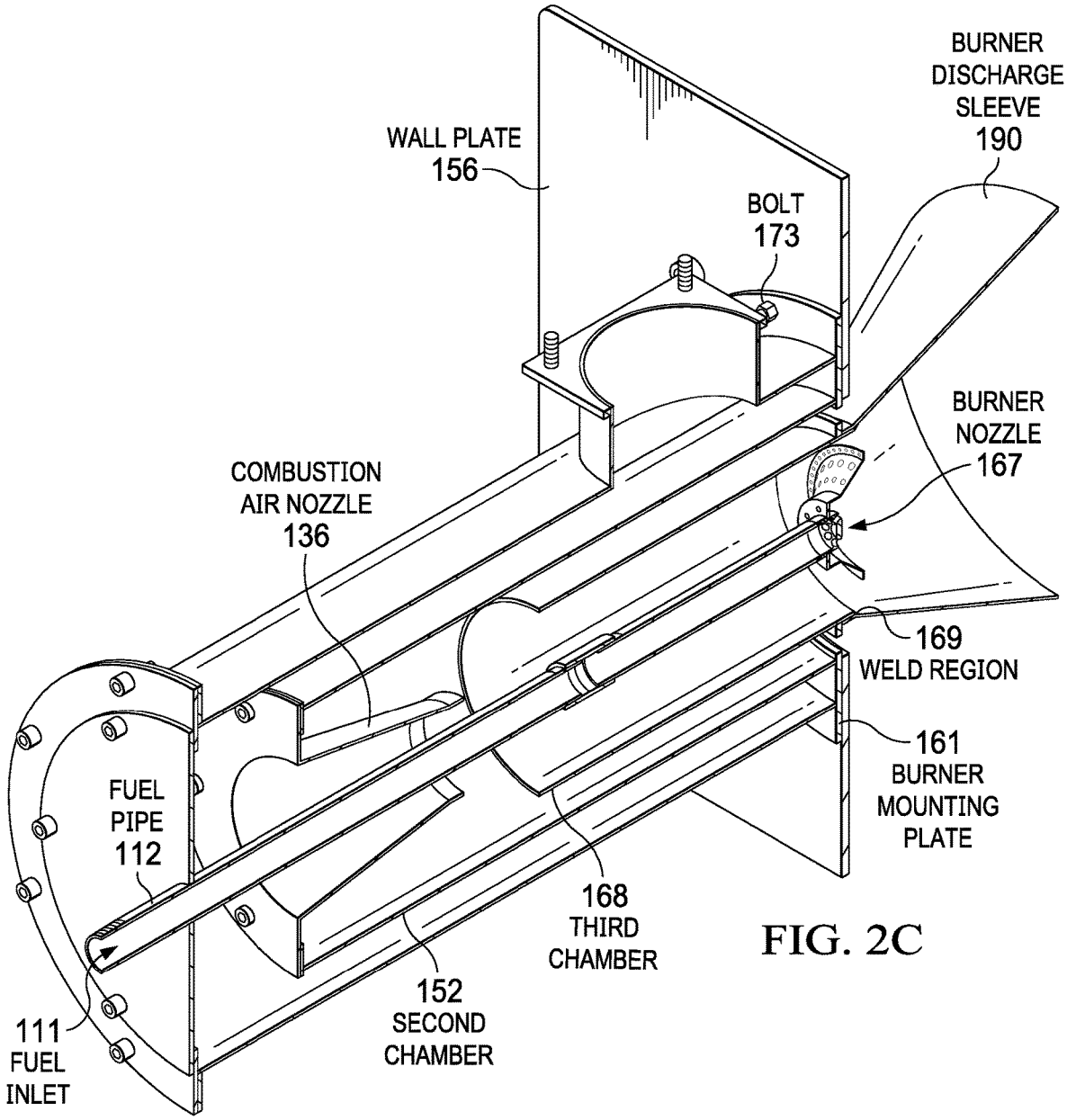

FIGS. 2A-C depict various views of the example fuel-fired burner including EGR comprising a jet pump arrangement provided inside the burner housing that mixes hot exhaust gas with combustion air to provide internal exhaust gas recycle as shown in FIG. 1A, according to an example aspect. FIG. 2A depicts a back view looking at the burner mounting plate 161 of an example fuel-fired burner and the wall plate 156 attached (shown as bolted on by bolts 173) to the burner mounting plate 161 that closes the burner housing 110. The recycle ports 164 are generally cut into the burning mounting plate 161, where the recycle ports 164 are shown only by example as being an annular-shaped region.

FIG. 2B depicts a fuel-fired burner taken along the cut line B-B shown in FIG. 2A. This FIG. depicts the direction of flow for the combustion air and the hot exhaust gas. The hot exhaust gas can be seen to make a turn inwards after flowing past the third chamber 168. FIG. 2C depicts a side cut view of the fuel-fired burner shown in FIG. 2A. The third chamber 168 can be seen to be fully open on its side facing the output of the combustion air nozzle 136.

A further benefit disclosed fuel-fired burners is that combustion air in the burner housing 110 cools the exhaust gas in the exhaust gas path framed by the second chamber 152. As a result, because the second chamber 152 generally comprises steel which is known to be thermally conductive, the combustion air also cools the second chamber 152. This cooling of the hot exhaust gas also transfers heat to the combustion air used for combustion, which in turn, increases the overall thermal efficiency of the combustion process for the fueled-fired burner 100 compared to a conventional "piped" EGR system.

Computational Fluid Dynamics (CFD) Simulation is one method that can be used to determine at least one design parameter for the fuel-fired burner 100. For example, design parameters for simulation for a disclosed fuel-fired burner can include the internal geometry, sizes of the recycle ports 164, and an orientation of the combustion air nozzle 136 relative to the third chamber 168.

Disclosed fuel-fired burners can be constructed of rolled and formed sheet metal, tubing, pipe such as comprising steel which can be welded, or can use another suitable high temperature tolerant material. For example, the burner housing 110 generally comprises shaped sheet-metal. The various connections between components can be made by bolting on with flanches or by welding, such as bolting on with flanches of the burner mounting plate 161 to the end of the burner housing 110, and securing the combustion air nozzle 136 to the second chamber 152 using a weld.

Disclosed aspects that as described above build entirely inside the burner housing 110 a jet pump that implements EGR can be applied to generally essentially any fuel-fired burner. A variety of fuel gases, such as natural gas or propane, or fuel liquids can be used.

While various disclosed aspects have been described above, it should be understood that they have been presented by way of example only, and not limitation. Numerous changes to the subject matter disclosed herein can be made in accordance with this Disclosure without departing from the spirit or scope of this Disclosure. In addition, while a particular feature may have been disclosed with respect to only one of several implementations, such feature may be combined with one or more other features of the other implementations as may be desired and advantageous for any given or particular application.

The invention claimed is:

1. A method, comprising:

providing a fuel-fired burner comprising a burner housing having a fuel inlet coupled to a fuel pipe coupled to a burner nozzle secured to a burner mounting plate that has at least one recycle port, a combustion air inlet for receiving combustion air coupled to a combustion air nozzle positioned beginning at an input to a second chamber within the burner housing having an output spaced apart from a third chamber also within the second chamber, wherein the combustion air nozzle is configured to direct the combustion air into the third chamber, and a jet pump is located entirely inside the burner housing;

directing the combustion air using a combustion air fan from the combustion air inlet through the combustion air nozzle;

directing fuel through the fuel pipe to the burner nozzle to implement a combustion process that generates a flame originating at the burner nozzle which generates a hot exhaust gas, and operating the jet pump by flowing the combustion air through the combustion air nozzle with a sufficient velocity for creating an impulse that suctions in the hot exhaust gas through the recycle port into the second chamber then into a gas mixing zone extending from an output of the combustion air nozzle to an input end of the third chamber which mixes the hot exhaust gas suctioned in with the combustion air received from the combustion air nozzle, wherein an area ratio of the third chamber to the output of the combustion air nozzle is 1.2 to 3.

2. The method of claim 1, wherein the jet pump comprises the combustion air nozzle as an input for the combustion air, with an exhaust gas path for receiving the hot exhaust gas positioned between outside of the third chamber and an inside of the second chamber.

3. The method of claim 1, further comprising a burner discharge sleeve welded onto the burner mounting plate or onto the third chamber.

4. The method of claim 1, wherein the recycle port comprises an annular shaped region.

5. The method of claim 2, wherein the hot exhaust gas suctioned into the exhaust gas path is cooled by the combustion air passing over the outside of the second chamber, wherein the cooling of the hot exhaust gas transfers heat to the combustion air to heat the combustion air, which increases an overall thermal efficiency of the combustion process.

6. The method of claim 1, further comprising using Computational Fluid Dynamics (CFD) simulation to determine at least one design parameter for the fuel-fired burner.

7. The method of claim 6, wherein the at least one design parameter comprises a size of the recycle port and an orientation of the combustion air nozzle relative to the third chamber.

8. A fuel-fired burner, comprising:

a burner housing;

a combustion air inlet for receiving combustion air coupled to a combustion air nozzle;

the combustion air nozzle positioned beginning at an input to a second chamber within the burner housing having an output spaced apart from a third chamber also within the second chamber, wherein the combustion air nozzle is configured to direct the combustion air into the third chamber;

a fuel inlet coupled to a fuel pipe for receiving fuel coupled to a burner nozzle secured to a burner mounting plate that has at least one recycle port;

an exhaust gas path for receiving hot exhaust gas from the recycle port, and a jet pump is located entirely inside the burner housing configured to receive the hot exhaust gas from the exhaust gas path, wherein the fuel-fired burner is configured for operating the jet pump by flowing the combustion air through the combustion air nozzle with a sufficient velocity for creating an impulse that suctions in the hot exhaust gas through the recycle port into the second chamber then into a gas mixing zone extending from an output of the combustion air nozzle to an input end of the third chamber which mixes the hot exhaust gas suctioned in with the combustion air received from the combustion air nozzle, wherein an area ratio of the third chamber to the output of the combustion air nozzle is 1.2 to 3.

9. The fuel-fired burner of claim 8, wherein the jet pump comprises the combustion air nozzle as an input for the combustion air, with an exhaust gas path for receiving the hot exhaust gas positioned between outside of the third chamber and an inside of the second chamber.

10. The fuel-fired burner of claim 8, further comprising a burner discharge sleeve welded onto the burner mounting plate or onto the third chamber.

11. The fuel-fired burner of claim 8, wherein the recycle port comprises an annular shaped region.

12. The fuel-fired burner of claim 8, wherein a size of the recycle port exclusively provides a passive control of the flowing of the hot exhaust flow gas into the jet pump.

13. The fuel-fired burner of claim 9, wherein the hot exhaust gas suctioned into the exhaust gas path is cooled by the combustion air passing over the outside of the second chamber, wherein the cooling of the hot exhaust gas transfers heat to the combustion air to heat the combustion air, which increases an overall thermal efficiency of the combustion process.

14. The fuel-fired burner of claim 8, further comprising using Computational Fluid Dynamics (CFD) simulation to determine at least one design parameter for the fuel-fired burner.

15. The fuel-fired burner of claim 14, wherein the at least one design parameter comprises a size of the recycle port and an orientation of the combustion air nozzle relative to the third chamber.

16. The fuel-fired burner of claim 15, wherein the size of the recycle port is designed to determine the amount of exhaust flowing into the exhaust gas path which is utilized by the jet pump.

17. The method of claim 1, wherein a size of the recycle port exclusively provides a passive control of the flowing of the hot exhaust flow gas into the jet pump.

18. The method of claim 17, wherein the size of the recycle port is designed to determine the amount of exhaust flowing into the exhaust gas path which is utilized by the jet pump.

* * * * *